US009545362B2

(12) United States Patent
Matthews et al.

(10) Patent No.: US 9,545,362 B2
(45) Date of Patent: Jan. 17, 2017

(54) SEALABLE MEDICINE DISPENSER HAVING A PRESELECTED DOSAGE AMOUNT

(71) Applicant: Kralmat Medical, LLC, Raleigh, NC (US)

(72) Inventors: Iwona Matthews, Raleigh, NC (US); Violetta Anna Kralka, Holly Springs, NC (US)

(73) Assignee: Kralmat Medical, LLC, Raleigh, NC (US)

( * ) Notice: Subject to any disclaimer, the term of this patent is extended or adjusted under 35 U.S.C. 154(b) by 0 days.

(21) Appl. No.: 14/282,635

(22) Filed: May 20, 2014

(65) Prior Publication Data

US 2015/0088097 A1 Mar. 26, 2015

Related U.S. Application Data

(63) Continuation-in-part of application No. 14/064,097, filed on Oct. 25, 2013, now abandoned.

(60) Provisional application No. 61/882,650, filed on Sep. 26, 2013.

(51) Int. Cl.

| | |
|---|---|
| ***A61J 7/00*** | (2006.01) |
| ***B65D 25/56*** | (2006.01) |
| *A61J 1/14* | (2006.01) |
| *B65D 77/20* | (2006.01) |

(52) U.S. Cl.

CPC ..... *A61J 7/0046* (2013.01); *B65D 25/56* (2013.01); *A61J 1/1412* (2013.01); *B65D 77/20* (2013.01)

(58) Field of Classification Search

CPC ..... A61J 1/1412; A61J 7/0046; B65D 25/08; B65D 85/804; B65D 85/816; B65D 77/20; A47G 19/22; A47G 19/2205; A47G 19/2272

See application file for complete search history.

(56) References Cited

U.S. PATENT DOCUMENTS 1,933,468 A * 10/1933 Abbot ..... 206/217
2,766,796 A * 10/1956 Tupper ..... 220/521
3,618,751 A 11/1971 Rich (Continued)

OTHER PUBLICATIONS

Calories in Rugrats Fruit Punch Applesauce, Calorie Count Website, URL: http://caloriecount.about.com/calories-motts-rugrats-fruit-punch-applesauce-i220577, accessed on Oct. 6, 2014.

(Continued)

*Primary Examiner* — Kami A Bosworth

(74) *Attorney, Agent, or Firm* — Olive Law Group, LLC

(57) ABSTRACT

A dispenser includes a vessel and an edible product within the vessel occupying less than the total interior volume such that an unoccupied portion of the interior volume remains for receiving a medication. A seal selectively seals the total interior volume of the vessel. A cup includes a base and an upstanding peripheral wall having a bottom margin connected to the base and an upper margin such that a total interior volume of the cup is defined within the peripheral wall between the base and upper margin. An edible product occupies a volume that is less than the total interior volume such that an unoccupied portion remains for receiving a medication. An exterior seal engages the upper margin of the wall sealing the total interior volume. The seal is disengaged to permit medicine to be mixed with the edible product.

14 Claims, 7 Drawing Sheets

(56) References Cited

U.S. PATENT DOCUMENTS

| | | | | | |
|---|---|---|---|---|---|
| 4,125,186 | A * | 11/1978 | Meierhoefer | 206/221 | |
| 4,874,618 | A * | 10/1989 | Seaborne et al. | 426/76 | |
| 5,584,388 | A * | 12/1996 | Johnson | A47G 33/002 | 206/19 |
| 5,746,312 | A | 5/1998 | Johnson | | |
| 5,941,411 | A * | 8/1999 | Langenbach | A47G 19/22 | 220/703 |
| 6,132,416 | A * | 10/2000 | Broselow | A61J 1/1412 | 128/898 |
| 6,189,688 | B1 * | 2/2001 | Aneas | B65D 25/08 | 206/219 |
| 6,488,146 | B1 * | 12/2002 | Dotsikas | 206/217 | |
| 2006/0171970 | A1 * | 8/2006 | Karl | A61K 9/0095 | 424/400 |
| 2006/0191805 | A1 * | 8/2006 | Vogel | B65D 25/087 | 206/222 |
| 2008/0044314 | A1 | 2/2008 | McIntyre et al. | | |
| 2009/0107861 | A1 * | 4/2009 | Crabtree | 206/221 | |
| 2013/0108739 | A1 * | 5/2013 | Markoulis | A47J 31/401 | 426/87 |

OTHER PUBLICATIONS

How to Get Kids to Take . . . Pills!, Ped-Onc Resource Center Website, https://www.google.com/webhp?sourceid=chrome-instant& ion=1&espv=2&ie=UTF-8#q=www.ped-onc.og%2Ftreatment%2FPills%2Fpills, access on Oct. 6, 2014.

* cited by examiner

SEALABLE MEDICINE DISPENSER HAVING A PRESELECTED DOSAGE AMOUNT

CROSS-REFERENCE TO RELATED APPLICATIONS

This application is a continuation-in-part application of and claims priority to U.S. patent application Ser. No. 14/064,097, titled SEALABLE MEDICINE DISPENSER HAVING A PRESELECTED DOSAGE AMOUNT and filed Oct. 25, 2013, which claims priority to and the benefit of U.S. Provisional Patent Application No. 61/882,650, titled SEALABLE MEDICINE DISPENSER HAVING A PRESELECTED DOSAGE AMOUNT and filed Sep. 26, 2013; the entire contents of which are incorporated herein by reference in their entireties.

TECHNICAL FIELD

This disclosure is directed towards a sealable medicine dispenser having a preselected dosage amount. More specifically, this disclosure is directed towards a sealable medicine dispenser for aiding in the ingestion of pharmaceutical, neutraceutical, vitamins, capsule, tablet, and other pills and/or medication taken orally.

BACKGROUND

Many patients struggle with ingesting entire pills, capsules, tablets and other solid medications, and even some liquid medications. In order to facilitate ingesting the medication, many times a healthcare provider or patient will crush the pill into a powder form and mix the powdered medication in which a food substrate in order to provide a taste pleasing formulation. For example, the powdered medication may be mixed in with apple sauce and the patient then consumes the apple sauce and powder mixture. In some instances, the pill or medicine may be broken in half or into parts. This mixture is typically provided in a medicine dispenser cup. The cup is then typically disposed of or, in some instances, may be sanitized for reuse. Additionally, sometimes entire, meaning non-crushed, medication, is intermixed with the apple sauce to aid in ingesting.

This practice has many disadvantages. For example, the practice is susceptible for transfer of bacteria and infection when the provider transfers, for example, the applesauce from the applesauce container to whatever container is being used to mix the powdered medication in with. Additionally, many times the patient may not want to consume the entire contents of, in the apple sauce example, the applesauce that the powdered medication is in. If the patient consumes less than the full amount, they do not receive the proper dosage of medication. This is particularly problematic if the health care provider is likely to provide more than a desired amount of the host food. Furthermore, sometimes the medication is placed in the container before the food product is added and the medication adheres to the bottom of the container and is not consumed.

For at least the foregoing reasons, there is a need for improved equipment and techniques for facilitating ingestion of medications.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein is a dispenser for dispensing a medication product. The dispenser includes a vessel that defines a volume. A food product is contained in the vessel. The food product has a volume less than the volume of the vessel such that a void is defined for receiving a medication. A seal is provided for selectively sealing the vessel.

In one or more embodiment, the seal is not re-engageable with the vessel after it is unsealed.

In one or more embodiments, the vessel defines measurement indicators on a side thereof.

In one or more embodiments, the void defines a volume that is greater than or about equal to a dosage amount of medication. The volume may be about the size of a teaspoon.

In one or more embodiments, the dispenser further includes a medication.

In one or more embodiments, the medication is a crushed pill, whole pill, capsule, tablet, liquid medication, or any other form of oral medication.

In one or more embodiments, a method of using the dispenser is provided. The method includes removing the seal, providing a selected dosage of medication into the food product, mixing the food product, and administering the contents to a patient.

In at least one embodiment, a dispenser includes a vessel having a total interior volume; an edible product within the vessel occupying a product volume of the vessel that is less than the total interior volume such that an unoccupied portion of the total interior volume remains for receiving a medication; and a seal for selectively sealing the total interior volume of the vessel.

In at least one example, the seal is not re-engageable with the vessel after it is unsealed.

In at least one example, the vessel defines measurement indicators on a side thereof.

In at least one example, the unoccupied portion of the total interior volume is greater than or about equal to a dosage amount of medication.

In at least one example, a medication is provided. In at least one example, the medication is one of a crushed pill, an entire pill, liquid medicine, or any other known oral medication.

In at least one example, an interior seal seals the product within product volume and prevents the product from occupying the unoccupied portion of the total interior volume.

A medicine dispensation system according to at least one embodiment includes: a cup having a base and an upstanding peripheral wall, the wall having a bottom margin connected to the base and an upper margin opposite the bottom margin such that a total interior volume of the cup is defined within the peripheral wall between the base and upper margin of the wall; an edible product within the cup occupying a product volume that is less than the total interior volume such that an unoccupied portion of the total interior volume remains for receiving a medication; and an exterior seal engaged with the cup along the upper margin of the wall sealing the total interior volume.

In at least one example, an interior seal seals the product within product volume and prevents the product from occupying the unoccupied portion of the total interior volume. In at least one example, the product is sealed between the base, the wall, and the interior seal, and the unoccupied portion of the total interior volume is sealed between the interior seal, the wall, and the exterior seal. In at least one example, the interior seal is a one-time use removable or frangible seal.

In at least one example, the exterior seal and interior seal are each approximately planar and are parallel to each other. In at least one example, the base of the cup has a diameter and the upper margin of the wall has a diameter that is greater than the diameter of the base such that the cup widens from the base to the upper margin.

In at least one example, an edible product portioned to be received in the unoccupied portion of the total interior volume is provided. In at least one example, the product comprises medicine.

In at least one example, a volume measurement indicator is provided on the wall of the cup.

In at least one example, a shaft and a rotary mixing element attached to the shaft are provided. The mixing element is dimensioned to fit within the cup.

In at least one embodiment, a method of administering a medicine according to at least one embodiment includes providing a cup having a base and an upstanding peripheral wall, the wall having a bottom margin connected to the base and an upper margin opposite the bottom margin such that a total interior volume of the cup is defined within the peripheral wall between the base and upper margin of the wall. In at least one embodiment, the method further includes providing an edible product within the cup occupying a product volume that is less than the total interior volume such that an unoccupied portion of the total interior volume remains for receiving a medication. In at least one embodiment, the method further includes providing an exterior seal engaged with the cup along the upper margin of the wall sealing the total interior volume. In at least one embodiment, the method further includes at least partially disengaging the exterior seal from the cup. In at least one embodiment, the method further includes providing a medicine portioned to be received in the unoccupied portion of the total interior volume. In at least one embodiment, the method further includes mixing the medicine and the product. In at least one embodiment, the method further includes administering the mixed product and medicine to a patient.

A method according to at least one embodiment further includes providing an interior seal that seals the product within product volume and prevents the product from occupying the unoccupied portion of the total interior volume, and before mixing the medicine and the product, unsealing the interior seal to permit mixing of the medicine and product. The edible product may be food.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Figure 1:
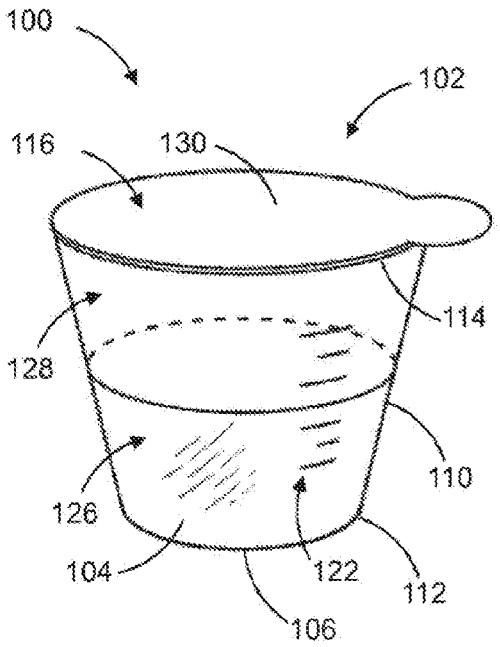
FIG. 1 is a perspective view of a dispenser having a food product and a seal engaged therewith according to one or more embodiments disclosed herein.

FIG. 1 illustrates a medicine dispensation system 100 according to one or more embodiments disclosed herein. The dispensation system 100 includes a vessel 102 that defines a volume therein for receiving an edible product 104 such as a food product. In the illustrated embodiment, the vessel 102 is configured as a cup having a base 106 and an upstanding peripheral wall 110. The wall has a bottom margin 112 connected to the base 106 and an upper margin 114 opposite the bottom margin 112 such that a total interior volume 116 of the vessel is defined within the peripheral wall 110 between the base 106 and upper margin 114 of the wall 110. In the illustrated example, the base 106 has a diameter and the upper margin 114 of the wall 110 has a diameter that is greater than the diameter of the base 106 such that the cup widens from the base 106 to the upper margin 114. In one or more embodiments, the vessel 102 may have a volume of about 1 liquid ounce.

Although the vessel 102 is illustrated as configured as a cup, the vessel 102 may be any appropriately configured vessel and may be, for example, sized similar to a medicine dispenser cup typically packaged with medicine products such as cough syrup or that is used for receiving, storing, and dispensing a collection of pills. The vessel 102 can be formed from medical grade quality material and may be formed of a clear or translucent plastic for viewing the contents therein. Additionally, the vessel 102 may be configured for having a solid color that is not translucent if desired. Indicia 120 (FIG. 3), which may include symbols, graphics, and text for instructional or illustrative purposes, may be provided on the vessel 102, for example on an exterior surface of the vessel. For example, a trademark, food product or medicinal content information, and any expiration dates or other data may be provided. The vessel 102 may include a writing area 124 for receiving handwritten or otherwise applied information or content. For example, information such as a patient name and medication being mixed can be written into the writing area 124 of the dispenser.

The vessel 102 may be plastic, medical grade, or any other appropriately configured material. The vessel 102 is illustrated as including measurement indicators 122 along a side of the vessel for measuring or confirming volumes dispensed into or from the vessel. In the illustrated embodiment, the measurement indicators 122 are configured as horizontal lines vertically positioned according to corresponding volume increments. Corresponding numeric or symbolic indicia may be present with the spaced lines to inform a user as to the volume scale of the indicators.

The vessel 102 is configured to have an edible product 104 such as a food product contained therein. The edible product 104 may be any appropriately configured product into which a medicine can be intermixed or dissolved. For example, the edible product 104 may be apple sauce, edible gelatin, pudding, yogurt, ice cream, juices, and the like. The edible product 104 is configured for occupying a product volume 126 (FIG. 2) of the vessel 102, but not the total interior volume 116, such that an unoccupied portion 128 of the total interior volume 116 remains for receiving a medication. In this manner, the unoccupied portion 128 of the total interior volume is formed where no edible product 104 is initially contained. This unoccupied portion 128 is provided for allowing space for receiving a medication product. The unoccupied portion 128 has a volume that is either equal to, or in excess of, a desired dosage volume of medication. The unoccupied portion 128 may be initially prepared as a vacuum or void or may be filled with air or other gas.

A seal 130 is provided for selectively sealing the vessel 102. In this manner, the seal 130 is provided after the edible product 104 is dispensed into the vessel 102 to seal the contents therein. The seal 130 may be a thin metallic seal with an adhesive on a vessel-facing side thereof, such as, for example, a plasticized aluminum foil seal with medical grade adhesive adhering the seal 130 to the vessel 102. In the illustrated embodiment, the seal 130 constitutes an exterior seal engaged with the vessel along the upper margin 114 of the wall 110 sealing the total interior volume 116 from contamination or loss of contents.

Additionally, any other type of seal may be employed, including a lid that can be twisted or otherwise disengaged from the vessel 102 when desired. In some embodiments, the seal 20 is not configured to be engaged with the vessel 102 once disengaged, such that the seal constitutes a one-time use removable, breakable, or frangible seal that, once broken or disengaged, cannot be readily reapplied. In this manner, the integrity and security of the edible product 104 can be confirmed by presence and engagement of the seal.

Figure 2:
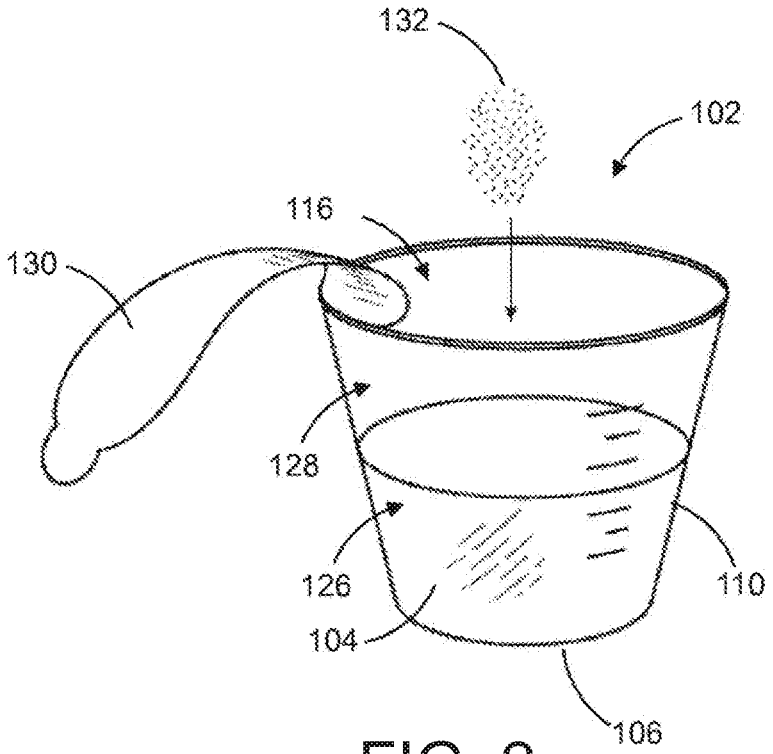
FIG. 2 is a perspective view of a dispenser having the seal at least partially disengaged therewith according to one or more embodiments disclosed herein.
Figure 3:
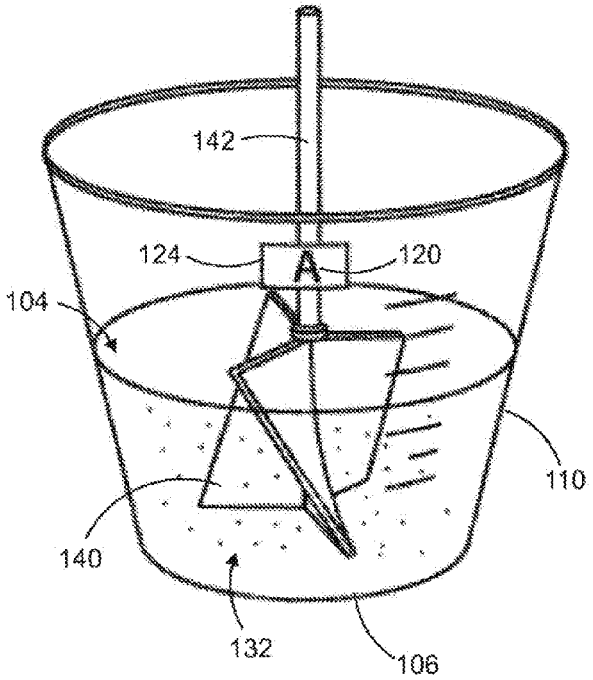
FIG. 3 is a perspective view of a dispenser having a medication being intermixed within a food product contained therein according to one or more embodiments disclosed herein.

In use, the medicine dispensation system 100 is provided as illustrated in FIG. 1. The seal 130 is then at least partially disengaged or removed from the vessel 102 as illustrated in FIG. 2. In the embodiment illustrated in FIG. 2, the seal 130 is at least partially peeled away from the vessel 102, although other seal designs may be employed. An ingestible product 132 such as a medication is then placed into the edible product 104. The ingestible product 132 may be a powdered, liquid, or crushed medication. For example, a pill that a patient could not otherwise swallow could be crushed or ground and then placed into the edible product 104. An entire pill, capsule, tablet, or any other oral medication can also be used. Then the ingestible product 132 and edible product 104 are mixed, for example as shown in FIG. 3, in preparation for consumption, for example by a patient.

In at least one embodiment, a rotary mixing element 140 (FIG. 3) attached to the end of a shaft 142 is provided with the medicine dispensation system 100. The mixing element 140 in the illustrated embodiment includes mixing blades attached to the shaft 142. The mixing element 140 is dimensioned to fit within the vessel 102 for mixing the food product 104 by rotation of the shaft 142 and rotary mixing element 140. The mixture prepared by intermixing the ingestible product 132 and edible product 104 product is then given to a patient.

Figure 4:
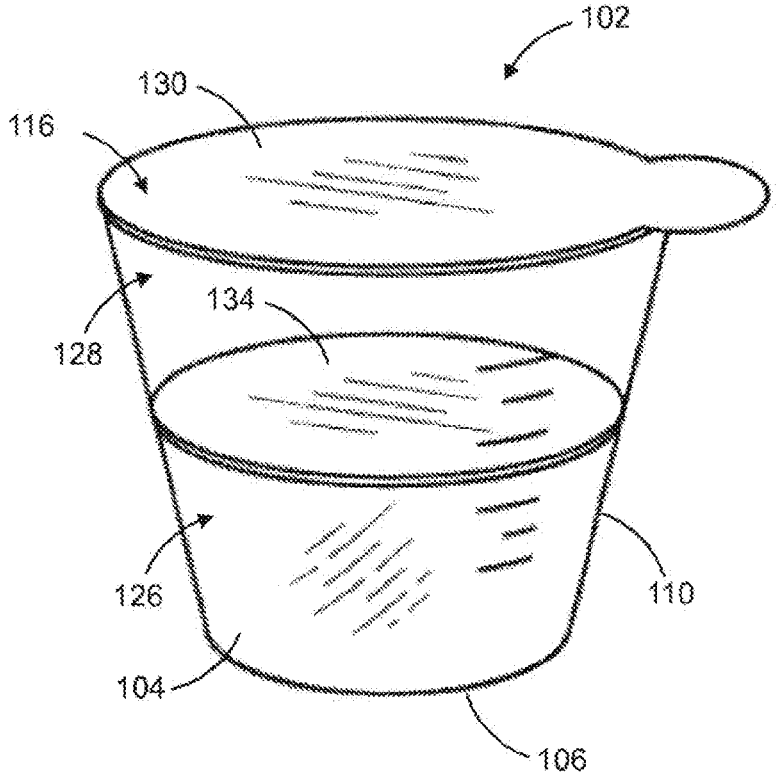
FIG. 4 is a perspective view of a dispenser having a second sealed assembly according to one or more embodiments disclosed herein.

FIG. 4 illustrates an alternate embodiment in which a second seal 134 is provided. This has the advantage of adding an additional layer of sealing protection, as well as reducing the chance for spillage or having food product projected out of the vessel 102. In the illustrated embodiment, the second seal 134 constitutes an interior seal that seals the edible product 104 within the product volume 126 and prevents the edible product 104 from occupying the unoccupied portion 128 of the total interior volume 116, particularly before mixing with an ingestible product such as a medication. In the illustrated embodiment, the product 104 is sealed between the base 106, the wall 110, and the interior seal 134, and the unoccupied portion 128 of the total interior volume 116 is sealed between the interior seal 134, the wall 110, and the exterior seal 130. The interior seal 134 may be a one-time use removable or frangible seal. Furthermore, in the illustrated example, the exterior seal 130 and interior seal 134 are each approximately planar and are parallel to each other. Before mixing an ingestible product 132 such as a medication with the edible product 104, the interior seal 134 is unsealed to permit mixing of the medicine and product.

Figure 5:
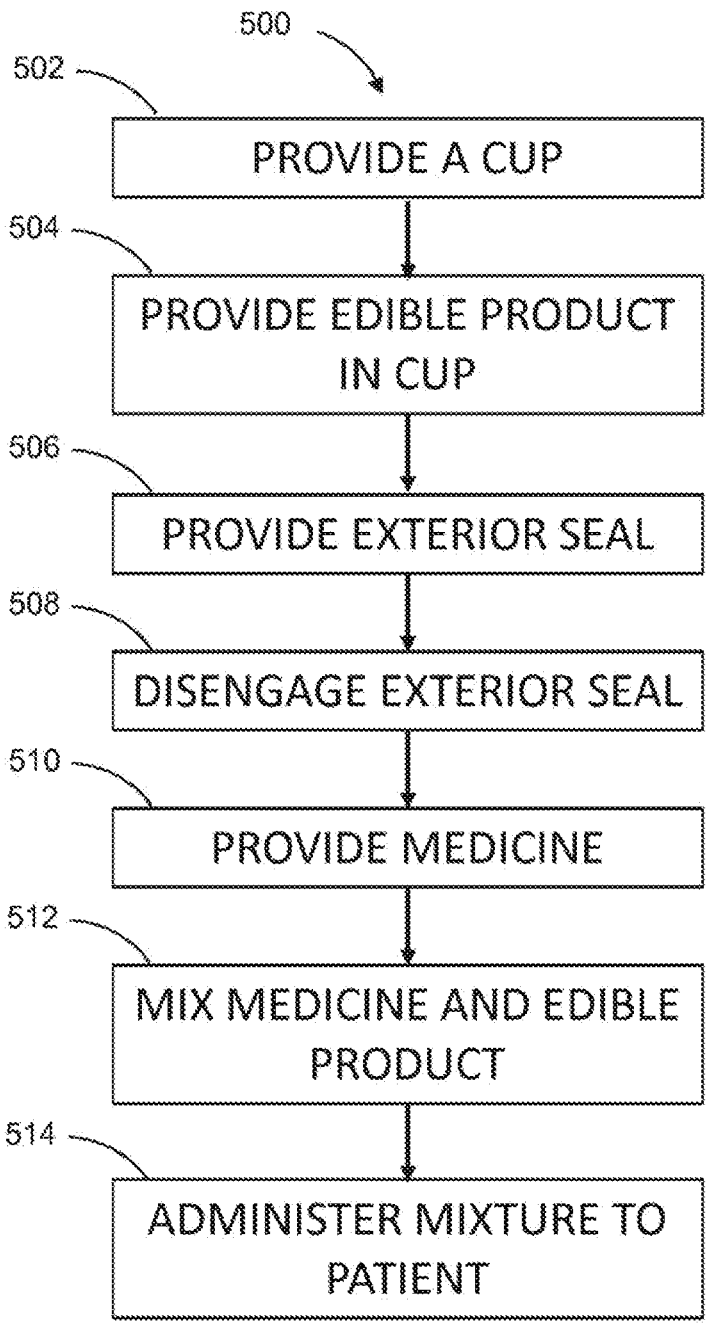
FIG. 5 is a flow chart representing an example method of administering a medicine according to at least one embodiment disclosed herein.

An example method 500 of administering a medicine according to at least one embodiment is represented by a flow chart in FIG. 5. Referring to FIG. 5, step 502 includes providing a cup having a base and an upstanding peripheral wall. The wall may have a bottom margin connected to the base and an upper margin opposite the bottom margin such that a total interior volume of the cup is defined within the peripheral wall between the base and upper margin of the wall.

Step 504 of FIG. 5 includes providing an edible product within the cup occupying a product volume that is less than the total interior volume such that an unoccupied portion of the total interior volume remains for receiving a medication. Step 506 includes providing an exterior seal engaged with the cup along the upper margin of the wall sealing the total interior volume. Step 508 includes at least partially disengaging the exterior seal from the cup. Step 510 includes providing a medicine portioned to be received in the unoccupied portion of the total interior volume. Step 512 includes mixing the medicine and the product. Step 514 includes administering the mixed product and medicine to a patient.

A method according to one or more embodiments may further include providing an interior seal that seals the product within product volume and prevents the product from occupying the unoccupied portion of the total interior volume, and before mixing the medicine and the product, unsealing the interior seal to permit mixing of the medicine and product. The edible product may be food.

The embodiments disclosed herein for the medicine dispensation system 100 and method 500 have the advantage of reducing the occurrence of bacterial or viral transfer associated with conventional methods previously described, may eliminate waste associated with such conventional methods, and may reduce the time needed for administering medication by a health care provider.

Figure 6:
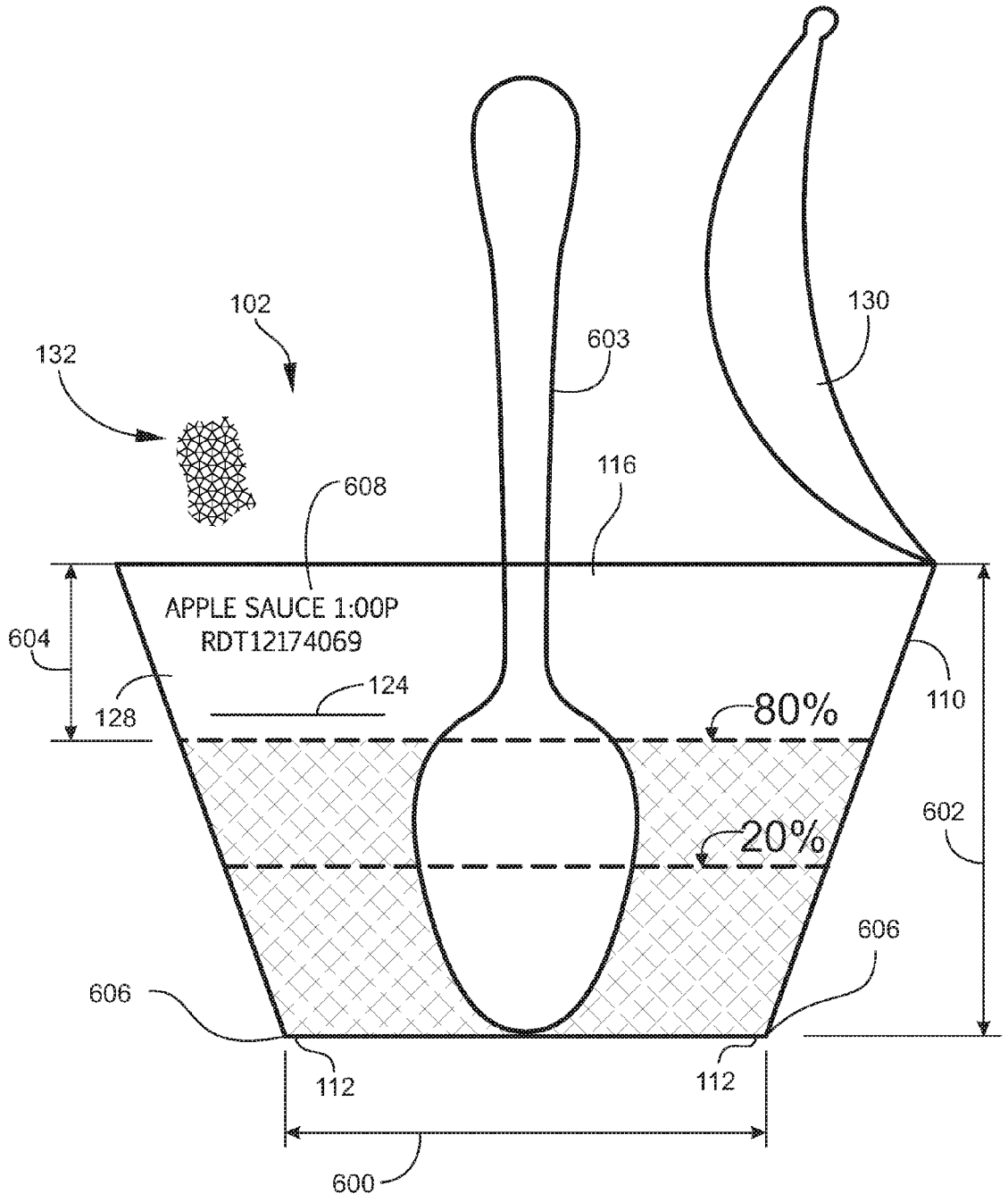
FIG. 6 is a cross-sectional side view of an example dispenser showing dispenser proportions such that a substantially thorough mix of edible product and an ingestible product is obtained in accordance with embodiments of the present subject matter.

FIG. 6 illustrates a cross-sectional side view of an example dispenser in accordance with embodiments of the present subject matter. Particularly, FIG. 6 shows dispenser proportions such that a substantially thorough mix of edible product 104 and an ingestible product 132 may be obtained in accordance with embodiments of the present subject matter. As described above, the dimensions of the vessel 102 are such that a substantially thorough mix of edible product 104 and an ingestible product 132 may be obtained. As a non-limiting example, the dimensions of the vessel 104 may have a base dimension 600 that is greater than the height dimension 602 of the peripheral wall 110. In this manner, a mixing utensil 603 may more easily create a substantially uniform blend of the edible product 104 and the ingestible product 132. The mixing utensil 603 is used to create a substantially uniform blend of the edible product 104 and the ingestible product 132. The vessel 102 may be designed such that the mixing utensil 603 is able to create a uniform blend of the edible first product 104 and the ingestible second product 132. In accordance with the embodiments of the present invention, as an example, the mixing utensil 603 may be configured to have a volumetric measure of approximately three-quarters (¾) of a teaspoon to one (1) tablespoon. The shape of the mixing utensil 603 may be of a teaspoon, dessert spoon or soup spoon, as non-limiting examples. The mixing utensil 603 may have a width from three-quarters (¾") to two (2") inches, as an example.

With continued reference to FIG. 6, the vessel 102 may define a shape and size such that a sufficient amount of edible product 104 may be dispensed in the vessel 102 in a product volume 126 prior to sealing the vessel 102 with the seal 130. In this manner, the seal 130 may be provided after the edible product 104 is dispensed into the vessel 102 to seal the contents therein. As described above, the seal 130 may be a thin metallic seal with an adhesive on a vessel-facing side thereof, such as, for example, a plasticized aluminum foil seal with medical grade adhesive adhering the seal 130 to the vessel 102. In the illustrated embodiment, the seal 130 constitutes an exterior seal engaged with the vessel along the upper margin 114 of the wall 110 sealing the total interior volume 116 from contamination or loss of contents as shown in FIG. 1 and FIG. 2.

With continued reference to FIG. 6, the vessel 102 may be configured to have an edible product 104 such as a food product contained therein. The edible product 104 may be any appropriately configured product into which a medicine can be intermixed or dissolved. For example, the edible product 104 may be apple sauce, edible gelatin, pudding, yogurt, ice cream, juices, and the like. The edible product 104 may occupy a product volume 126 of the vessel 102, but not the total interior volume 116, such that an unoccupied portion 128 of the total interior volume 116 remains for receiving a medication. In this manner, the unoccupied portion 128 of the total interior volume 116 may be formed where no edible product 104 is initially contained. This unoccupied portion 128 may be provided for allowing space for receiving the ingestible product 132 or medication product. The unoccupied portion 128 has a volume that may be either equal to, or in excess of, a desired dosage volume of medication. The unoccupied portion 128 may be initially prepared as a vacuum or void or may be filled with air or other gas. The unoccupied portion 128 may be predetermined based on an anticipated amount of the ingestible product 132. As a non-limiting example, the predetermined unoccupied portion 128 may range from about 20%-80% of the total interior volume 116. The edible product 104 occupies the remaining 20%-80% of the total interior volume 116 in a product volume 126. The amount of edible product 104 occupying the remaining 20%-80% of the total interior volume 116 may be predetermined based on the several factors. The amount of edible product 104 predetermined based on the several factors may include the size, weight and age of the patient. The several factors may also include the type of need of the patient or the type of ingestible product 132. For example, if the patient is not able or willing to ingest more than 2 or 3 servings of the blended edible product 104 and the ingestible product 132 using the mixing utensil 603, then the amount of the edible product 104 may be sized to accordingly. Additionally, if more ingestible product 132 is desired, then the amount of edible product 104 may be sized as appropriate to accommodate a blend of edible product 104 and ingestible product 132 most desirable for either the application of the ingestible product 132 or for the desires of the patient. For example, if the blend of ingestible product 132 to edible product 104 is too diluted any refusal by the patient to consume all of the blended product would preclude the patient from receiving all of the ingestible product 132. In this manner, the unoccupied portion 128 may be predetermined and controlled to maximize 604 the unoccupied portion 128 for the desired ingestible product 132.

With continued reference to FIG. 6, the vessel 102 may be configured such that the bottom margin union 606 of the bottom margin 112 and the peripheral wall 110 may be smooth and manufactured with no discernable ridge. In this manner, with no ridge, the mixing utensil 603 may more effectively mix or blend the edible product 104 and the ingestible product 132 leaving little to substantially no ingestible product 132 that is not blended or mixed into the edible product 104.

Additionally, the vessel 102 may comprise indicia 608 which may include symbols, graphics, and text for instructional, measurement or illustrative purposes. The indicia 608 may be provided on the vessel 102, for example on an exterior surface of the vessel 102. For example, a trademark, food product or medicinal content information, and any expiration dates or other data may be provided. The vessel 102 may include a writing area 124 for receiving handwritten or otherwise applied information or content. For example, information such as a patient name and medication being mixed can be written into the writing area 124 of the dispenser.

Figure 7:
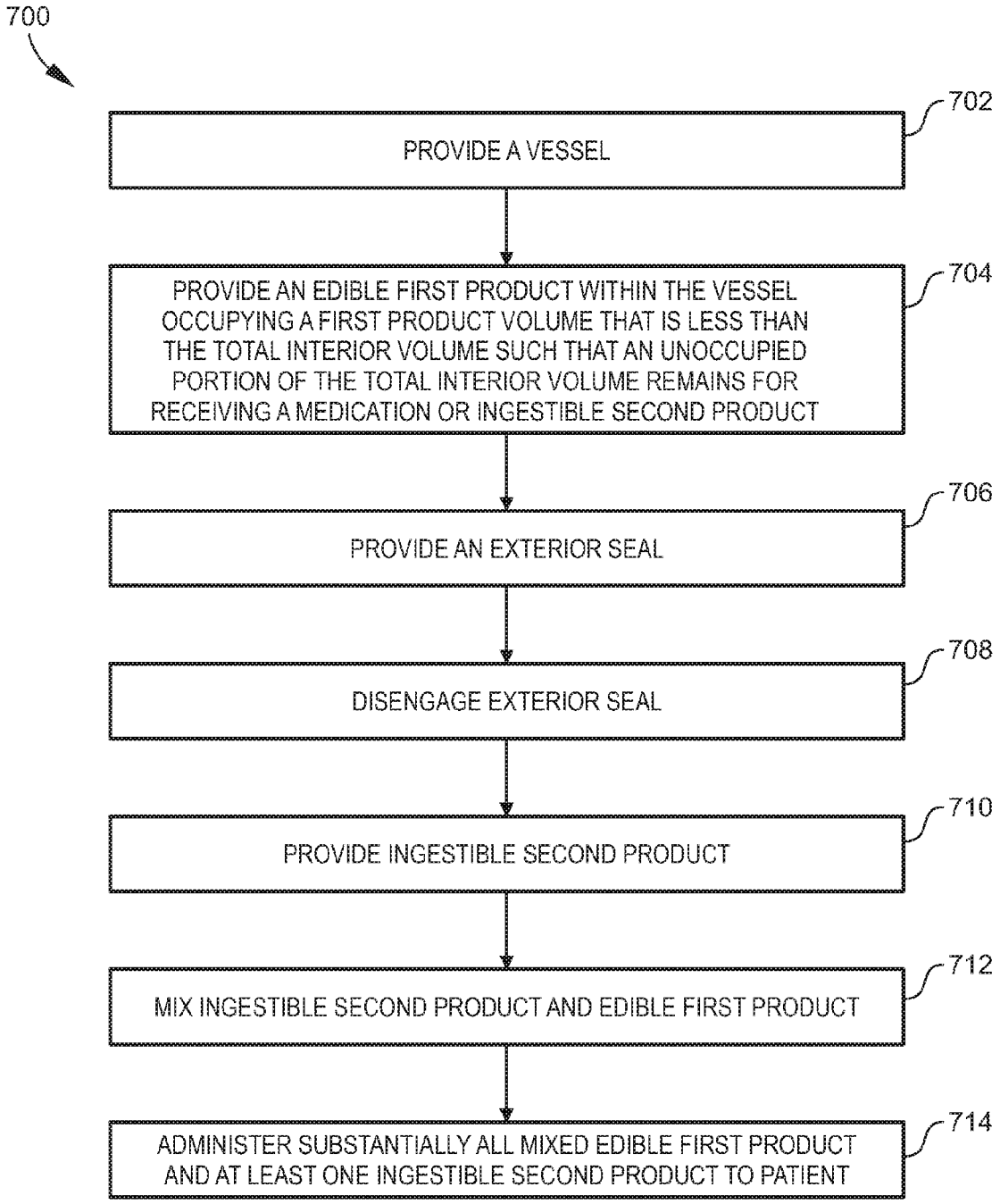
FIG. 7 is a flow chart of an example method for administering a substantially thorough mix of the edible product and an ingestible product in accordance with embodiments of the present subject matter.

FIG. 7 illustrates a flow chart of an example method 700 for administering a substantially thorough mix of an edible product and an ingestible product in accordance with embodiments of the present subject matter. In this example, reference is made to vessel and edible and ingestible products depicted in FIG. 67, although it should be understood that the method may alternatively be applied to any suitable vessel or cup and products.

Referring to FIG. 7, the method includes providing 702 a cup or vessel 104 having the base 106 and the upstanding peripheral wall 110. The upstanding peripheral wall 110 has a bottom margin 112 connected to the base 106 and an upper margin 114 opposite the bottom margin 112 such that a total interior volume 116 of the vessel 102 may be defined within the peripheral wall between the base and upper margin of the wall. Additionally, the base 106 may preferably have a base dimension 600 greater than a height dimension 602 of the upstanding peripheral wall 110. As an example, the base dimension 600 may be one and three-eighths (1⅜") inches and the height dimension 602 of the upstanding peripheral wall 110 may be one (1) inch. Alternatively, the base dimension 600 and the height dimension 602 may independently vary by up to one (1") inch in each dimensional direction, as an example. The method includes providing 704 an edible product 104 within the vessel 102 occupying a product volume 126 that may be less than the total interior volume 116 such that an unoccupied portion 128 of the total interior volume 116 remains for receiving a medication or ingestible product 132. The edible product 104 may be a predetermined amount maximizing the unoccupied portion 128 of the total interior volume 116 in a controlled manner leaving sufficient space in the interior volume for mixing the ingestible product 132 into the edible product 104. The method includes providing 706 an exterior seal 130 engaged with the vessel 102 along the upper margin of the wall sealing the total interior volume. The method includes at least partially disengaging 708 the exterior seal from the vessel 102. The method includes providing 710 the ingestible product 132 or medicine portioned to be received in the unoccupied portion 128 of the total interior volume 116. The method includes mixing 712 or blending the ingestible product 132 or medicine with the edible product 104. The method includes administering 714 the substantially mixed edible product 104 and the ingestible product 132 or medicine to a patient.

With continued reference to FIG. 7, a method according to at least one embodiment may further include providing an interior seal 134 that seals the edible product 104 within product volume 126 and prevents the edible product 104 from occupying the unoccupied portion 128 of the total interior volume 116, and before mixing the ingestible product 132 or medicine and the edible product 104, unsealing the interior seal 134 to permit mixing of the ingestible product 132 or medicine and edible product 104.

Features from one embodiment or aspect may be combined with features from any other embodiment or aspect in any appropriate combination.

While the embodiments have been described in connection with the various embodiments of the various figures, it is to be understood that other similar embodiments may be used or modifications and additions may be made to the described embodiments for performing the same function without deviating therefrom. Therefore, the disclosed embodiments should not be limited to any single embodiment, but rather should be construed in breadth and scope in accordance with the appended claims.

What is claimed:

1. A dispenser consisting of:

a vessel defining an interior and an opening, the interior comprising first and second portions, the first portion being a predetermined volume and less than a total volume of the interior, and the second portion being the remainder of the total volume of the interior, wherein a medication is disposed within the second portion, wherein the predetermined volume is based on at least one of an age, a size and a weight of a person;

an edible product occupying the first portion of the interior;

a first seal configured to cover the opening for enclosing the edible product;

a second seal positioned entirely in the second portion of the interior; and wherein the vessel is comprised of a base having a base diameter and a peripheral wall having a height dimension, wherein the base diameter is greater than the height dimension, and wherein a diameter of an upper margin of the vessel is greater than the base diameter, and wherein the peripheral wall forms a continuous tapered shape that extends from the base to the upper margin.

2. The dispenser according to claim 1, wherein the first portion is about 20% -80% of the interior.

3. The dispenser according to claim 1, wherein the medication is one of a crushed pill, an entire pill, liquid medicine, a partial pill, and an oral medication.

4. The dispenser according to claim 1, wherein the first portion is less than 80% of the interior.

5. The dispenser according to claim 1, wherein the vessel is labeled indicating an expiration date of the edible product.

6. A medicine dispensation system consisting of:

a cup having a base and an upstanding peripheral wall, the wall having a bottom margin connected to the base and an upper margin opposite the bottom margin such that an interior of the cup is defined within the peripheral wall between the base and upper margin of the wall, the interior comprising first and second portions, the first portion being less than a total volume of the interior, and the second portion being the remainder of the total volume of the interior, wherein an ingestible product is received in the second portion of the interior, wherein the first portion is predetermined based on at least one of an age, a size and a weight of a person;

an edible product occupying the predetermined first portion of the interior;

an exterior seal configured to cover the upper margin for enclosing the edible product in the first portion and the second portion of the interior;

an interior seal positioned entirely in the second portion above the edible product; and wherein the base has a base diameter and the peripheral wall has a height dimension, wherein the base diameter is greater than the height dimension, and wherein a diameter of the upper margin is greater than the base diameter, and wherein the peripheral wall forms a continuous tapered shape that extends from the base to the upper margin.

7. The medicine dispensation system according to claim 6, wherein the interior seal is configured to prevent the edible product from occupying the second portion.

8. The medicine dispensation system according to claim 7, wherein:

the edible product is sealed between the base, the wall, and the interior seal.

9. The medicine dispensation system according to claim 7, wherein the interior seal is a one-time use removable or frangible seal.

10. The medicine dispensation system according to claim 6, wherein the ingestible product is medicine.

11. The medicine dispensation system according to claim 6, wherein the second portion is less than 80% of the interior.

12. The medicine dispensation system according to claim 6, wherein the cup is labeled indicating an expiration date of the edible product.

13. A method of administering a medicine comprising:

providing a dispensation system consisting of:

a cup having a base and an upstanding peripheral wall, the wall having a bottom margin connected to the base and an upper margin opposite the bottom margin such that an interior of the cup is defined within the peripheral wall between the base and upper margin of the wall, the interior comprising first and second portions, the first portion being less than a total volume of the interior, and the second portion being the remainder of the total volume of the interior, wherein the first portion is predetermined based on at least one of an age, a size and a weight of a person;

an edible product occupying the predetermined first portion of the interior;

an exterior seal configured to cover the upper margin for enclosing the edible product in the first portion and the second portion of the interior;

an interior seal positioned entirely in the second portion above the edible product; and wherein the base has a base diameter and the peripheral wall has a height dimension, wherein the base diameter is greater than the height dimension, and wherein a diameter of the upper margin is greater than the base diameter, and wherein the peripheral wall forms a continuous tapered shape that extends from the base to the upper margin.

14. The method according to claim 13, wherein the second portion is less than 80% of the interior.

* * * * *